United States Patent [19]

Potwin

[11] 4,142,687

[45] Mar. 6, 1979

[54] ADJUSTABLE ARM FOR SHREDDER HAMMER

[75] Inventor: David R. Potwin, Oconomowoc, Wis.

[73] Assignee: The Heil Co., Milwaukee, Wis.

[21] Appl. No.: 860,427

[22] Filed: Dec. 14, 1977

[51] Int. Cl.[2] ..... B02C 13/16

[52] U.S. Cl. ..... 241/194; 241/197

[58] Field of Search ..... 241/188 R, 194, 197

[56] References Cited

U.S. PATENT DOCUMENTS

| | | | |
|---|---|---|---|
| 2,460,279 | 2/1949 | Ehmann | 241/197 X |
| 3,022,018 | 2/1962 | Knight | 241/197 |
| 3,471,093 | 10/1969 | Wienert | 241/194 X |
| 3,979,078 | 9/1976 | Boddeker et al. | 241/197 X |

FOREIGN PATENT DOCUMENTS

| | | | |
|---|---|---|---|
| 868472 | 12/1941 | France | 241/197 |

*Primary Examiner*—Howard N. Goldberg

*Attorney, Agent, or Firm*—Wheeler, Morsell, House & Fuller

[57] ABSTRACT

In a hammermill or the like and employing hammerheads with sockets which receive the rotor hammer arms, slots are provided in the hammer arms to receive cross pins which extend through apertures in the hammerheads and the slots to hold the hammerheads to the arms. Spacers having a convex outer surface which is complementary to the curved slot ends and a concave inner surface complementary to the curvature of the pins are employed to positively position the pins in the desired position in the slots and thus, by use of different size spacers, enable adjustment of the radial extension of the hammerheads with respect to the arms to compensate for wear and maintain a desired clearance with the working chamber wall and thus maintain a desired particle size.

5 Claims, 8 Drawing Figures

ADJUSTABLE ARM FOR SHREDDER HAMMER

BACKGROUND OF INVENTION

In hammermills, grinders or shredders which employ a plurality of hammers which are rotated in a working chamber the particle size is determined by the clearance between the hammers and the fixed and wall parts of the working chamber. It is necessary to maintain a specific particle size when the materials being shredded or comminuted are re-cycled or further processed. Because of severe wear on the hammerheads, it is difficult to maintain the required product particle size for extended periods. The severe wear requires frequent servicing of the hammers which can include rebuilding the hammers in place with a welding process, replacing the worn hammers and rebuilding the used hammers for future use or discarding the worn hammers and installing new ones. These procedures are expensive and result in considerable down time.

In conventional prior art hammermills the hammers are pinned to the rotor arms with no provision to change the position of the hammer with respect to the arm.

SUMMARY OF INVENTION

The invention provides adjustment capability in the mounting arrangement of the hammerheads on the rotor arms of a hammermill rotor so that they can be adjusted radially to compensate for wear, and to enable adjustment of clearance with the walls of the working chamber to maintain a selected particle size. The hammer arms are provided with slots and the slotted arm portions are received in the sockets of the hammerheads. Cross pins used to secure the hammerheads to the slots are positioned in the slots with spacers of different sizes, with the spacer size being selected to provide the desired radial extension of the hammerhead. The spacers have concave and convex surfaces of the same radius, with the convex surface interfitting in the complementary surface of the slot end. The concave spacer surface is complementary to the surface of the cross pins to interfit with the cross pins and positively position the cross pins in the slot.

In hammermills employing a tapered liner with the hammers located at different distances from the rotor, a single length arm can be employed with the hammers located at different positions using spacers of different sizes in the hammer arm slots.

Further objects, advantages and features of the invention will become apparent from the disclosure.

DESCRIPTION OF PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
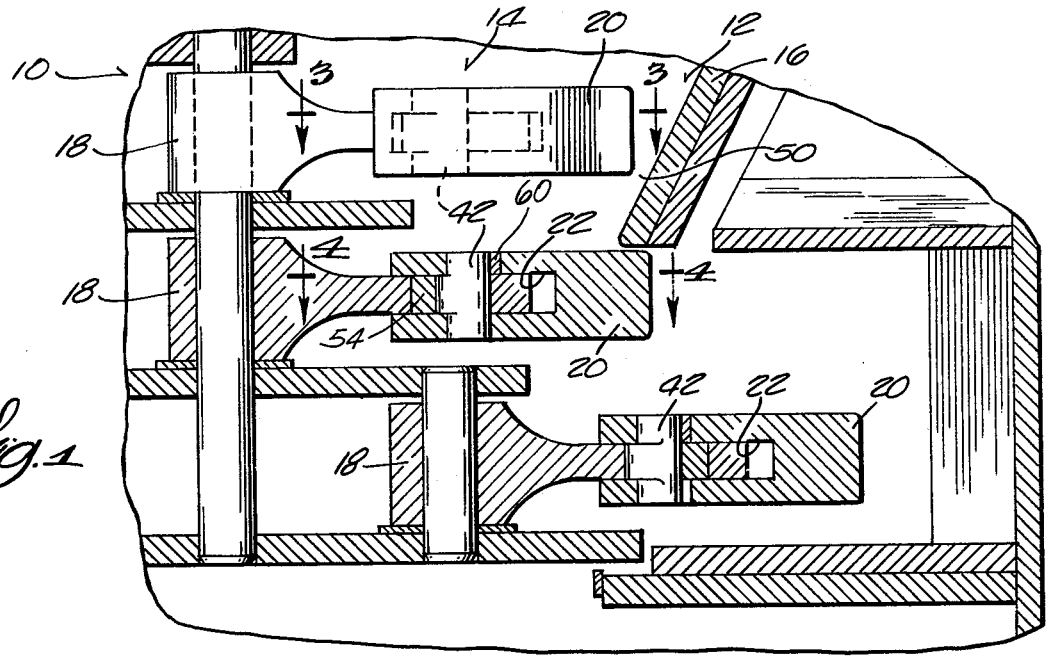
FIG. 1 is a fragmentary sectional view of a portion of a hammermill showing the hammer fastening arrangement of the invention.
Figure 2:
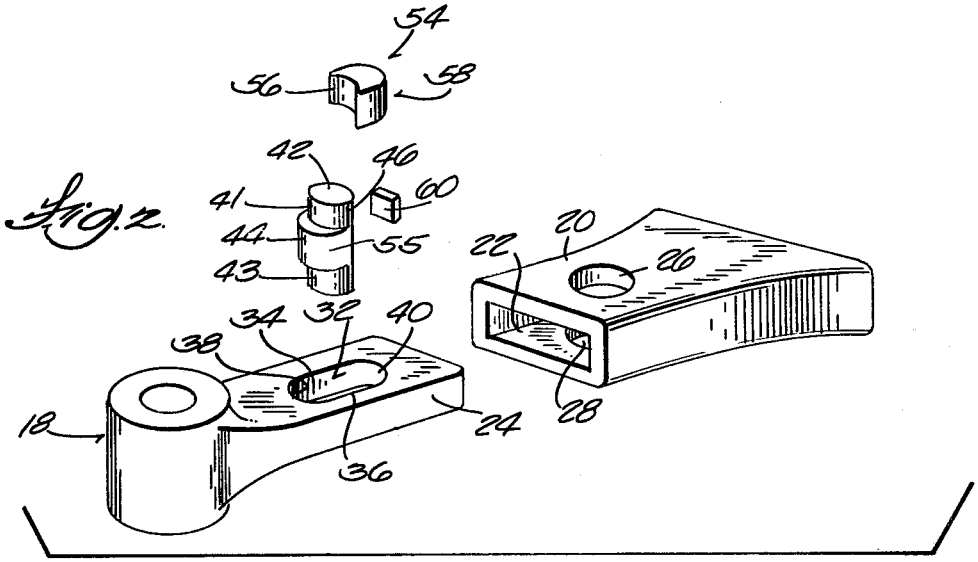
FIG. 2 is an exploded perspective view of a hammerhead and arm and the fastening and position adjustment components of the invention.

In the drawings, FIG. 1 shows a motor driven rotor 10 located in a working chamber 12 of a mill 14. The mill 14 can be for example a hammermill, grinder, pulverizer or shredder as are commonly known and in use in solid waste reduction, resource recovery, recycling of material and other size reduction processes. The mill 14 includes a tapered liner 16. The rotor 10 carries a plurality of arms 18 to which are connected hammerheads 20. As shown in FIG. 2, the hammerheads 20 include a socket 22 which receives the end 24 of a hammer arm 18. The hammerheads 20 are conventionally secured to the arms 18 by cross pins which extend through apertures 26 and 28 in the hammerheads. In conventional construction an aperture was provided in the arm 18 to secure the hammerhead to the arm.

In accordance with the invention, means are provided for connecting the hammerhead to the arm to provide adjustment of the radial position or extension of the hammerhead with respect to the arm. In the disclosed construction the means include elongated slots 32 in the arms 18. The slots 32 have parallel spaced walls 34 and 36 which are joined by arcuate end surfaces 38 and 40. The walls 34 and 36 are spaced to receive a cross pin 42 which secures the hammers 20 to the arms as subsequently described. The cross pin 42 is provided with an arcuate rib 44 which has the same radius as the cylindrical surface 46 of the pin 42. The rib 44 is formed by machining surfaces 41 and 43 on a center which is offset from the center of the surface 55 of the rib 44. The co-axial apertures 26 and 28 in the hammers 20 communicate with the socket 22 and are sized to receive the cross pin 42 including the rib 44.

To positively position the pin 42 in the desired location in a slot 32 and to provide the desired clearance of the hammerhead 20 at the gap 50 (FIG. 1) with the liner 16, spacers 54 are provided. The spacers 54 have a concave surface 56 and a convex surface 58 (FIG. 2). The surfaces 56 and 58 have generally the same radius as the radius of curvature of the slot end walls 38 and 40 and the same radius as the surfaces 44 and 46 of the cross pin. Thus the spacers 54 interfit with the slot and surface 46 of the cross pin and the cross pin rib 44, as best illustrated in FIGS. 3 through 8. The spacers 54 have the same thickness as the arm portion 55 (FIG. 6) so that they will fit in the hammerhead sockets 22.

Figure 5:
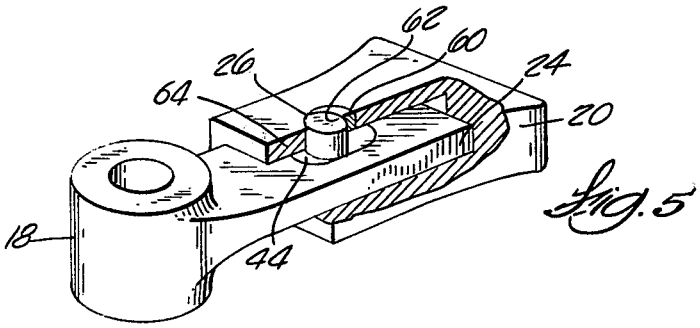
FIG. 5 is a perspective view, with parts broken away of a hammerhead and arm assembly in accordance with the invention.

The pins 42 and spacers 54 are held in place by a block 60 (FIG. 2) which, as shown in FIG. 5, is driven in between the aperture wall 62 of aperture 26 and the pin 42 to urge the pin against the opposite wall portion 64 to locate the rib 44 beneath the hammer wall 64 to prevent inadvertent loss of the pin. When the parts are assembled as shown in FIG. 5, the walls of the hammerhead hold the spacers in the socket.

Figure 3:
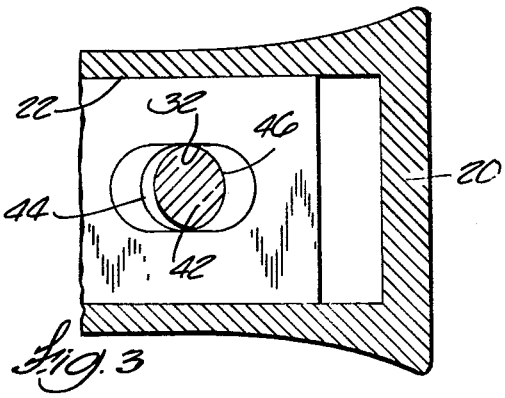
FIG. 3 is a sectional view along the line 3—3 of FIG. 1.
Figure 4:
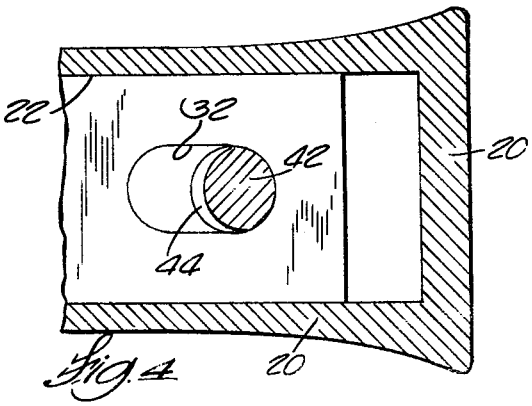
FIG. 4 is a view along line 4—4 of FIG. 1
Figure 6:
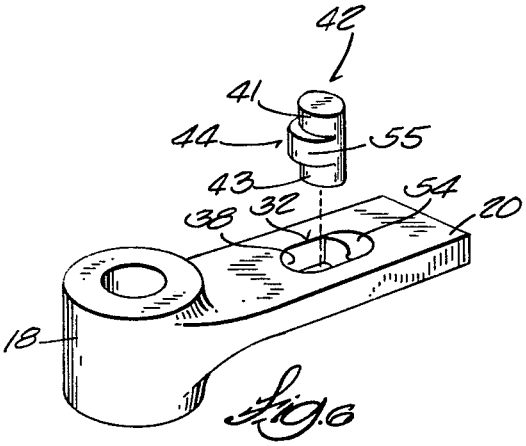
FIG. 6 is a perspective view showing a spacer in one position in the arm slot.
Figure 7:
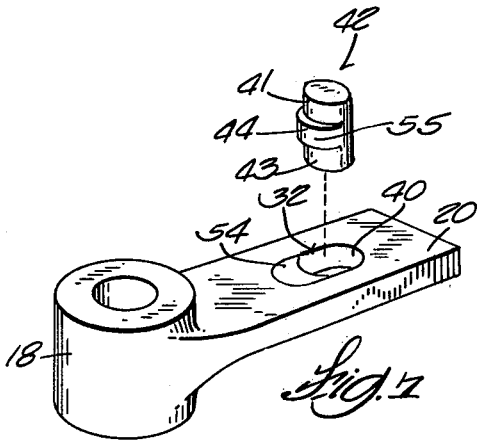
FIG. 7 is a perspective view showing a spacer in a second position in the arm slot.
Figure 8:
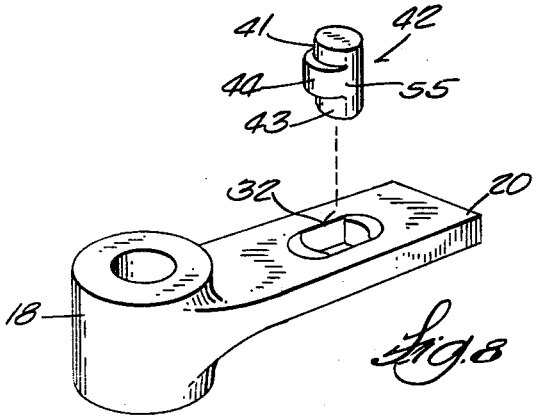
FIG. 8 is a perspective view showing two spacers in the arm slot.

Spacers of different sizes and one or two spacers can be employed to effect positive positioning of the pins and hammerheads 20. In FIG. 3 two spacers are employed. In FIG. 4 a single spacer is used and the arms 18 are the same length. In FIGS. 6 and 7 single spacers are illustrated at opposite ends of the slot 32. Double spacers are shown in FIG. 8 with the spacers in allochiral relation. It is apparent that the length of slot 32 can be varied to provide the degree of adjustment capability desired. The arms illustrated in FIGS. 3 and 4 are the same length but, as illustrated in FIG. 1, the hammerheads have a different projection distance from the rotor because of the use of different size spacers and spacer arrangements.

What is claimed is:

1. In a mill having a working chamber, a rotor, means to rotate the rotor within said chamber, a plurality of arms connected to and extending from the rotor, said arms having free ends, working elements having sockets for receiving the ends of said arms, the improvement comprising means for connecting the working elements to said arms to provide adjustment of the radial position of the working elements with respect to said rotor, said means including pins for holding said working elements on said arms, slots in said arms, apertures in said working elements registrable with said slots to receive said pins, spacer means receivable in said slots to locate the pins in a selected position in said slots, and means to secure the pins in said apertures in said working elements.

2. The improvement of claim 1 wherein said slots have arcuate ends and wherein said spacers have an outside surface complementary in shape to said arcuate ends of said slots and said spacers interfit in said slots.

3. The improvement of claim 1 wherein said pins have a cylindrical surface and said spacers have a concave surface complementary in shape to the cylindrical surface to embrace said surface.

4. The improvement of claim 1 wherein said pins have an arcuate rib with an outer surface and said spacers have a complementary concave surface to interfit with the rib outer surface.

5. The improvement of claim 1 wherein said slots have a sufficient length to receive spacers on opposite sides of said pin to position said pin intermediate the ends of said slots.

* * * * *